US006185397B1

(12) United States Patent
Kumar et al.

(10) Patent No.: US 6,185,397 B1
(45) Date of Patent: Feb. 6, 2001

(54) PIN CHARGE COROTRON FOR MINIMUM OZONE PRODUCTION

(75) Inventors: Ajay Kumar, Fairport; Dhirendra C. Damji, Webster, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/425,897

(22) Filed: Oct. 25, 1999

(51) Int. Cl.[7] ..... G03G 15/02
(52) U.S. Cl. ..... 399/173; 250/324; 361/229
(58) Field of Search ..... 399/170, 173; 361/225, 229; 250/324, 325, 326

(56) References Cited

U.S. PATENT DOCUMENTS 3,744,898 * 7/1973 Kurahashi et al. ..... 399/153
4,879,100 * 11/1989 Tsutsui et al. ..... 422/186.05
5,101,107 * 3/1992 Stoot ..... 250/324
5,504,560 * 4/1996 Kitagaki et al. ..... 399/168
5,666,605 * 9/1997 Tokimatsu et al. ..... 399/173
5,845,179 * 12/1998 Damji et al. ..... 399/173

* cited by examiner

*Primary Examiner*—Robert Beatty
(74) *Attorney, Agent, or Firm*—Lloyd F. Bean, II

(57) ABSTRACT

A charging apparatus for applying a uniform electrostatic charge to a charge retentive surface is provided. There is also provided a housing; an array of pin electrodes supported by said housing and positioned adjacent said surface in a non-contact relationship; wherein each pin in said array being composed of austenitic stainless steel; a power supply operatively coupled to said pin electrodes for supplying a predetermined current to each of said pin electrode, wherein said predetermined current ranges from 5 $\mu$A/pin and which co-acts with a protruding distance of the pins from the housing so as to optimize the charge uniformity and to minimize the ozone generated within said charging apparatus.

4 Claims, 4 Drawing Sheets

PIN CHARGE COROTRON FOR MINIMUM OZONE PRODUCTION

Cross reference is made to the following applications filed U.S. Pat. No. 5,845,179, and U.S. App. No. 09/427,058 entitled "PIN CHARGE COROTRON FOR MINIMUM OZONE PRODUCTION" filed herewith which are hereby incorporated by reference.

BACKGROUND

This invention relates to electrostatographic reproduction machines, and more particularly to a pin charge corotron with optimum dimensions for minimum ozone production.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" of the original image.

The charging of the photoconductive surface is used to prepare the surface for the exposure step so that a latent image may be formed on the photoconductive surface. The latent image is developed with marking particles and transferred to a substrate to form the copy. Charging of the surface is typically accomplished through an electrical device which generates ions which charge the surface. The formation of ions by the charging device often generates ozone as well as other undesirable emissions which are controlled.

To minimize the ozone irradiating from a printing machine, printing machines frequently include ozone filters which add cost to the printing machine. Furthermore, ozone problems may cause power fluctuations within the printing machine. Further, the generation of ozone may cause electrical noise to occur within the printing machine. Further, the generation of ozone may cause the charging process to become more unstable. Further, the generation of ions through the charging process requires a large power consumption.

SUMMARY OF INVENTION

There is provided a charging apparatus for applying a uniform electrostatic charge to a charge retentive surface, said apparatus including a housing; an array of pin electrodes supported by said housing and positioned adjacent said surface in a non-contact relationship; said pin array comprises austenitic stainless steel.

BRIEF DESCRIPTION OF THE DRAWINGS

In the detailed description of the invention presented below, reference is made to the drawings, in which.

DETAILED DESCRIPTION OF THE INVENTION

Figure 1:
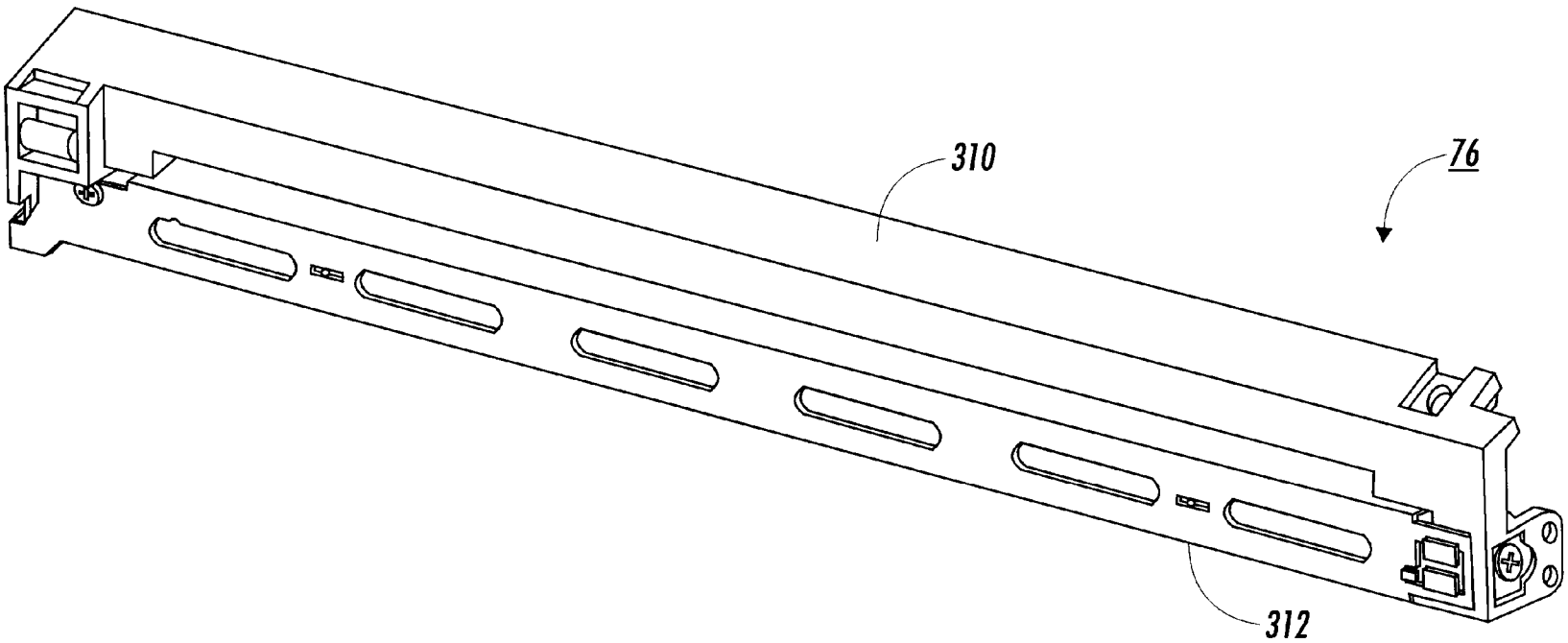
FIG. 1 is a perspective view of a pin charge corotron according to the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Referring now to FIGS. 1–4, the corotron 76 is shown in greater detail. The corotron 76 preferably includes a housing or body 310 which may be made of any suitable durable material. Preferably the material is one which may withstand the high voltages and other elements of the charging environment. For example, the housing 310 may be made of polycarbonate with glass fillers. Other materials may include Noryl or PEP.

The corotron 76 further includes a shield 312 preferably having a U shape. The U shaped shield 312 is mounted to the housing 310. The shield 312 surrounds the electrode 314.

Figure 2:
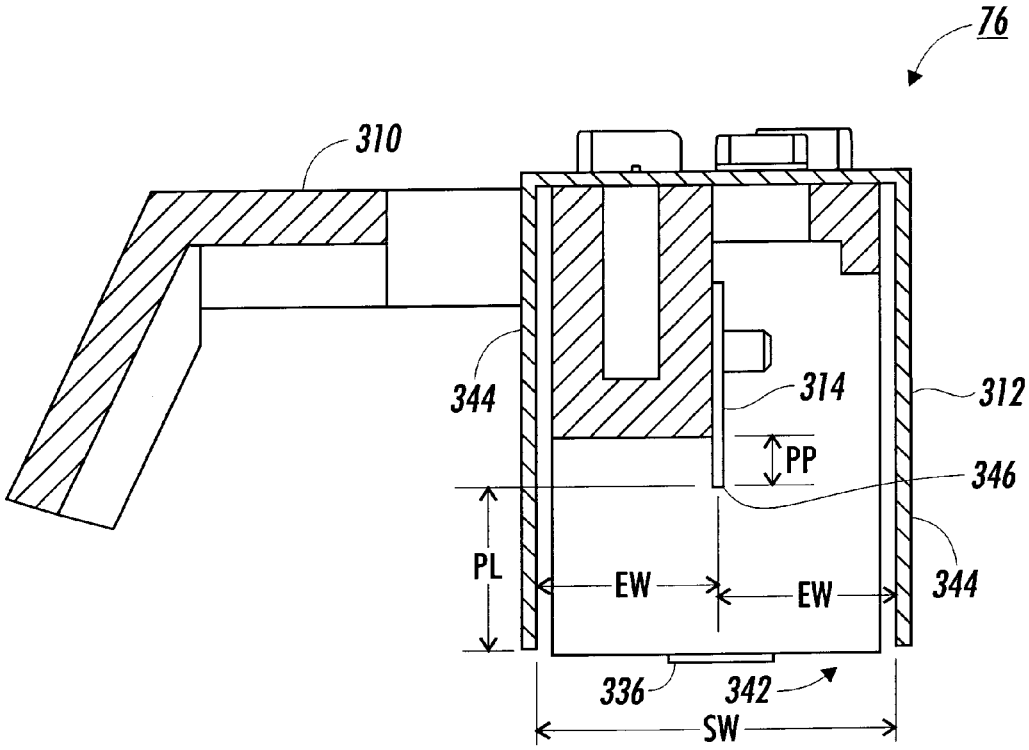
FIG. 2 is a cross sectional view of FIG. 1 along the line 8—8 in the direction of the arrows.
Figure 3:
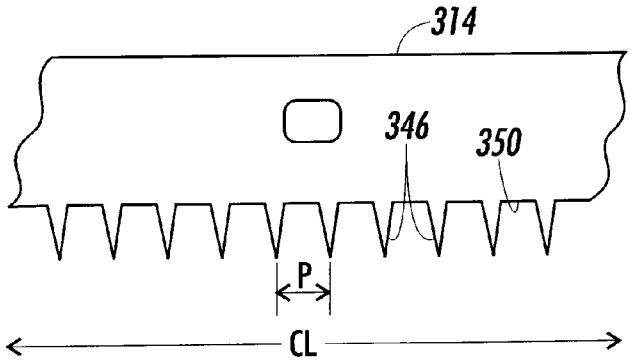
FIG. 3 is a partial plan view of the pin electrode of FIG. 1.
Figure 4:
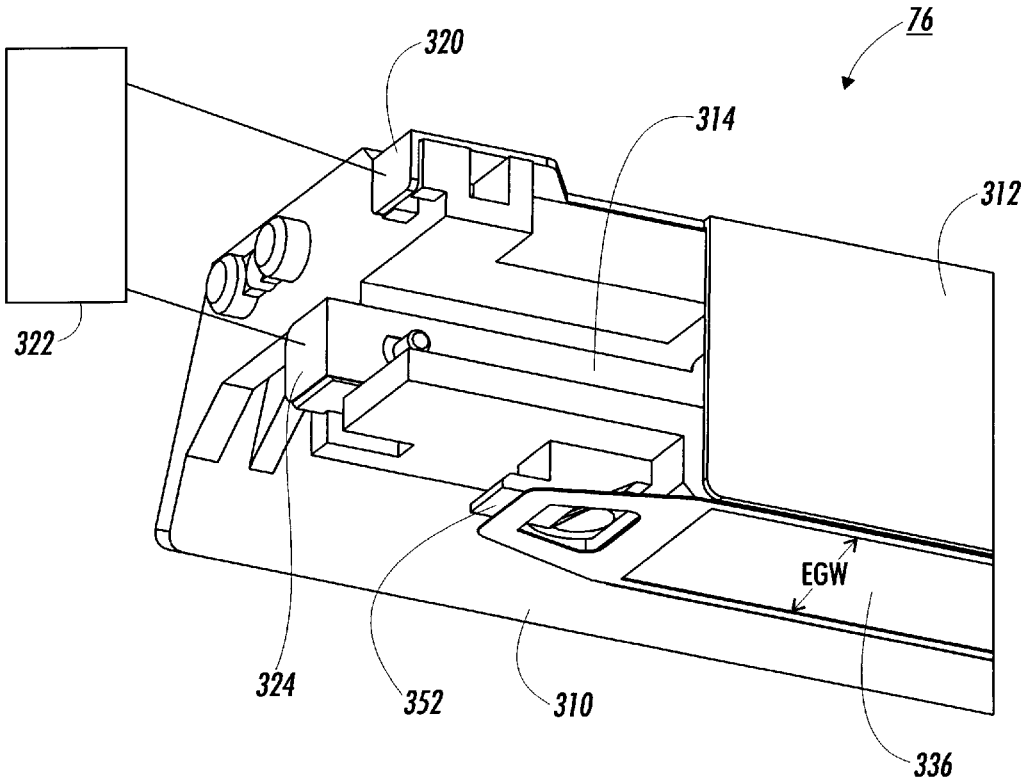
FIG. 4 is an end view of the pin electrode of FIG. 1.

As shown in FIG. 2,the electrode 314 is mounted to the housing 310 and is spaced from the shield 312. The shield 312 surrounds the electrode 314. The shield 312 may be made of any suitable durable material, capable of transferring an electrical current. For example, the shield 312 may be made of stainless steel. The shield 312 includes a shield connector 320 which is operatively connected to power supply 322.

The electrode 314 is positioned a distance EW from the side walls 344 of the shield 312 the distance EW is preferably 6.45 inches from each wall 344. Further, the electrode 314 includes pins 346 which extend a distance PL of preferably 5.9 mm from the open end 342 of the shield 312. Further, the pins 346 protrude ~2 mm from the housing 310 of the corotron 76. After extensive research efforts applicants have found that two parameters in combination work together to reduce ozone and improve charging uniformity, first is providing −5 $\mu$A/pin and pins have a distance PP about 2.5 mm plus or minus 0.1 mm.

The electrode 314 is preferably in the form of a pin type electrode and may be made of stainless steel. After extensive research efforts applicants have found that stainless steel is austenitic stainless steel (SUS 304 FH) being full harden with the grain (rolling direction) of the steel is in the direction in which the pins points. Pins are formed by a one sided photo-etching process is preferred. Applicants have found that this stainless steel (SUS 304 FH) exhibits reduce magnetic field properties when in use thereby reducing toner contamination of pins when employing magnetic toners in the printing system.

In the photo etching process the surface of the stainless steel is chemically cleaned to remove any contaminates thereon, a photo resist mask material is applied on both planar surfaces; UV light pattern of the desire pin pattern is exposed onto photo resist on the both planar surfaces so that pins are orientated pins are in the direction of the grain of stainless steel; both planar surface are developed to remove the photo resist in the areas which metal will be removed; next an etchant sprayer faces only one planar surface and removes unwanted metal areas. Finally, photoresist layer is removed from finished pin array.

Figure 5:
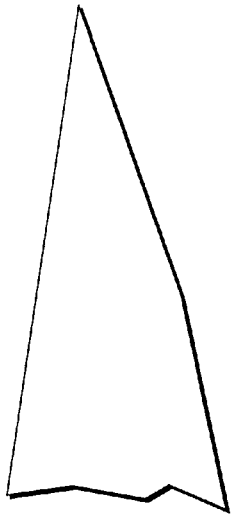
FIG. 5 is an enlarge view of cross-section profile of a pin array fabricated with an one sided etching process.
Figure 6:
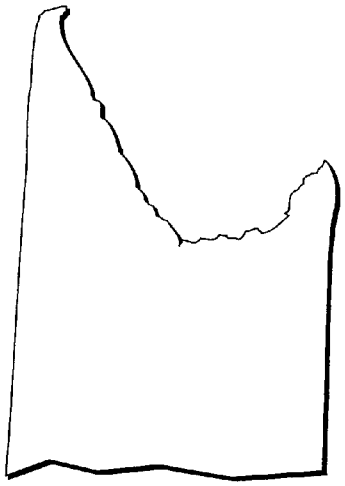
FIG. 6 is an enlarge view of cross-section profile of a pin array fabricated with a two sided etching process.

Applicants have found that final pin array has an improved cross-section profile which exhibits less variation in tip radius and unwanted edges than prior two sided photo etching method of producing pin arrays (as shown in FIG. 5) Applicants have found that cross-section profile of a pin array fabricated with two-side process arrays (as shown in FIG. 6) exhibits changes to the tip radius and applicants believes that variation in tip radius interferes with uniformity of charging characteristics of pin array over time. Applicants have found many of uniformity problems and increases of unwanted ozone are due to silica forming on these unwanted edges.

Applicants have found that one sided etched pin array has an improved cross-section profile which exhibits a low ozone output of for example 0.2 parts per million thereby alleviating the need for ozone filters in such printing machine; is more tolerant of power fluctuations; is more tolerant of electrical noise and has reduced power consumption.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A charging apparatus for applying a uniform electrostatic charge to a charge retentive surface, said apparatus comprising:

a housing;

an array of pin electrodes supported by said housing and positioned adjacent said surface in a non-contact relationship; said pin array comprises austenitic stainless steel and a power supply operatively coupled to said pin electrodes for supplying a predetermined current to each of said pin electrode, wherein said predetermined current is about 5 $\mu$A/pin and which co-acts with a protruding distance of the pins from the housing so as to optimize the charge uniformity and to minimize the ozone generated within said charging apparatus.

2. A charging apparatus according to claim 1, wherein each of said pin in said array protrudes a distance from the housing of 2.5 mm plus or minus 0.1 mm.

3. A charging apparatus according to claim 1, further comprising a generally U shaped shield connected to said housing and at least partially surrounding said array of pin electrodes.

4. A charging apparatus according to claim 1, further comprising a grid positioned across distal ends of said shield, said grid defining an effective charge length and an effective grid width.

* * * * *